US007216586B1

(12) United States Patent
Yu

(10) Patent No.: US 7,216,586 B1
(45) Date of Patent: May 15, 2007

(54) PORTABLE STAMP ASSEMBLY

(75) Inventor: Yuan-Tsai Yu, Sinjhuang (TW)

(73) Assignee: Megilo Co. Ltd, Sinjhuang (TW)

( * ) Notice: Subject to any disclaimer, the term of this patent is extended or adjusted under 35 U.S.C. 154(b) by 0 days.

(21) Appl. No.: 11/350,653

(22) Filed: Feb. 9, 2006

(51) Int. Cl.
*B41K 1/42* (2006.01)

(52) U.S. Cl. ..... 101/333; 101/405

(58) Field of Classification Search ..... 101/405, 101/406, 327, 333
See application file for complete search history.

(56) References Cited

U.S. PATENT DOCUMENTS 1,814,170 A * 7/1931 Long ..... 101/35
2,919,645 A * 1/1960 Leeds ..... 101/368
3,972,284 A * 8/1976 Bell ..... 101/327
4,928,594 A * 5/1990 Bostick ..... 101/405
6,199,482 B1 * 3/2001 Yasoshima ..... 101/333
6,829,989 B2 * 12/2004 Chudy ..... 101/35
6,877,425 B2 * 4/2005 Lynton ..... 101/333
2003/0089258 A1 * 5/2003 Rigoni ..... 101/405

* cited by examiner

*Primary Examiner*—Anthony H. Nguyen

(57) ABSTRACT

A portable stamp assembly includes a cover composed of an upper cover and a lower cover pivotally connected to the upper cover. An ink receptacle is securely received in the lower cover and a plate having a pattern formed on a side thereof is pivotally connected to the upper cover. When the plate is at the first position, the plate is received in the first receiving space of the upper cover to have the pattern in constant engagement with ink inside the ink receptacle. When the plate is at the second position, the plate is connected to the lower cover so as to allow the upper cover, the lower cover and the plate to form a triangle.

5 Claims, 4 Drawing Sheets

PORTABLE STAMP ASSEMBLY

BACKGROUND OF THE INVENTION

1. Field of the Invention

The present invention relates to a portable stamp assembly, and more particularly to a portable stamp assembly having a plate a side of which is pivotally connected to an upper cover and an ink receptacle securely received in a lower cover such that the pattern on the plate is in engagement with the ink when the upper cover and the lower cover are connected to each other and when the upper cover and the lower cover are detached with one another, the plate is ready to ink the pattern on a surface.

2. Description of the Prior Art

A conventional stamp is made of wood or a kind of rare stone. When this conventional stamp is in use, the user will have to prepare an ink receptacle first such that the pattern on the stamp end is able to be printed on a surface. Because the stamp and the ink receptacle are two separated objects, preparation of these two different objects may cause unnecessary troubles, such as when either one is misplaced, the user cannot use the stamp to print the required pattern. In order to obviate the shortcoming, a different stamp assembly is introduced to the market and has a receptacle defined therein a first receiving space for receiving a stamp and a second receiving space for receiving ink so that the stamp assembly is quite handy for use.

However, when placing the stamp end in the ink, the user's fingers may easily get stained by the ink. Removing the stain may also take a lot of time. Therefore, it is required to provide an improved stamp assembly to prevent the user's fingers from being stained.

To overcome the shortcomings, the present invention tends to provide an improved portable stamp to mitigate the aforementioned problems.

SUMMARY OF THE INVENTION

The primary objective of the present invention is to provide a portable stamp assembly having a plate a side of which is pivotally connected to an upper cover and an ink receptacle securely received in a lower cover such that when the upper cover and the lower cover are connected to each other, a pattern on one side of the plate is in engagement with the ink of the ink receptacle and when the upper cover is pivotal relative to the lower cover, the plate having the ink evenly spread on the pattern is ready for use.

Other objects, advantages and novel features of the invention will become more apparent from the following detailed description when taken in conjunction with the accompanying drawings.

DETAILED DESCRIPTION OF THE PREFERRED EMBODIMENT

Figure 1:
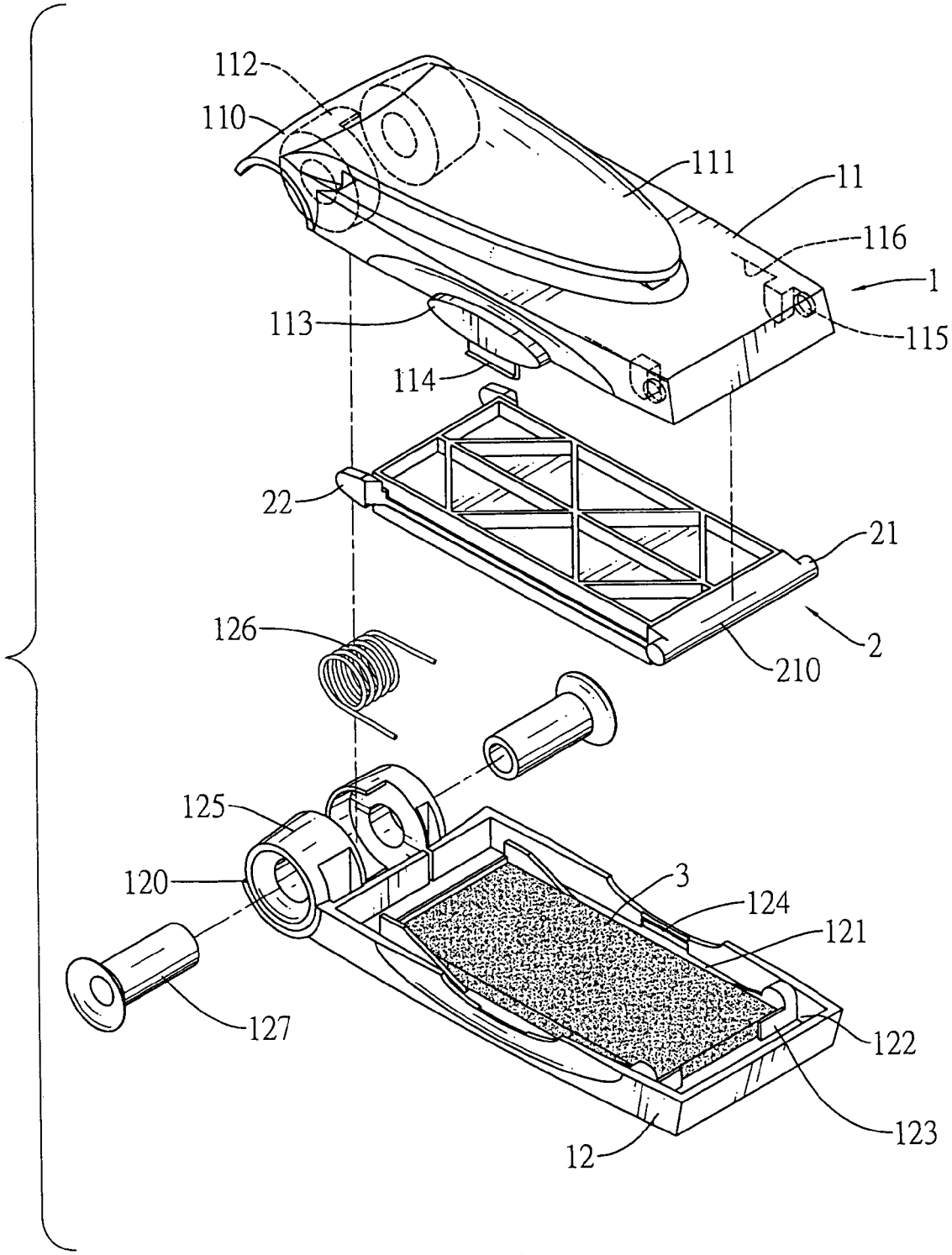
FIG. 1 is an exploded perspective view of the portable stamp assembly of the present invention.

With reference to FIG. 1, it is noted that the portable stamp assembly in accordance with the present invention includes a cover (1), a plate (2) and an ink receptacle (3).

The cover (1) is composed of an upper cover (11) and a lower cover (12) pivotally connected to the upper cover (11). The upper cover (11) has a first stop (110) formed on one end thereof, a clip (111) formed on an outer side thereof, a connecting block (112) formed on a side of a bottom face thereof and adjacent to the stop (110), two arms (113) integrally and oppositely formed from the bottom face thereof and each arm (113) having a ledge (114) formed on an outer side of the arm (113), two pivot holes (15) defined in two opposite inner sides of the upper cover (11) and a first receiving space (116) defined in the bottom face of the upper cover (11).

The plate (2) is pivotally connected to the upper cover (11) and has two ears (21) respectively extending from two opposite sides thereof to correspond to the two pivot holes (15) of the upper cover (11) and two extensions (22) oppositely formed relative to the two ears (21).

The lower cover (12) is provided with a second stop (120) formed on a side thereof to correspond to the first stop (110) to limit angle between the upper cover (11) and the lower cover (12), a second receiving space (121) defined to receive therein the ink receptacle (3), two receiving recesses (122) separated from the second receiving space (121) by at least one baffle (123) (two are shown), two clamping slits (124) defined in two opposite walls thereof to correspond to the two ledges (114) of the upper cover (11), two pivot blocks (125) formed on a side thereof and each pivot block being hollow and having two open ends, a spring (126) and two pins (127).

Figure 2:
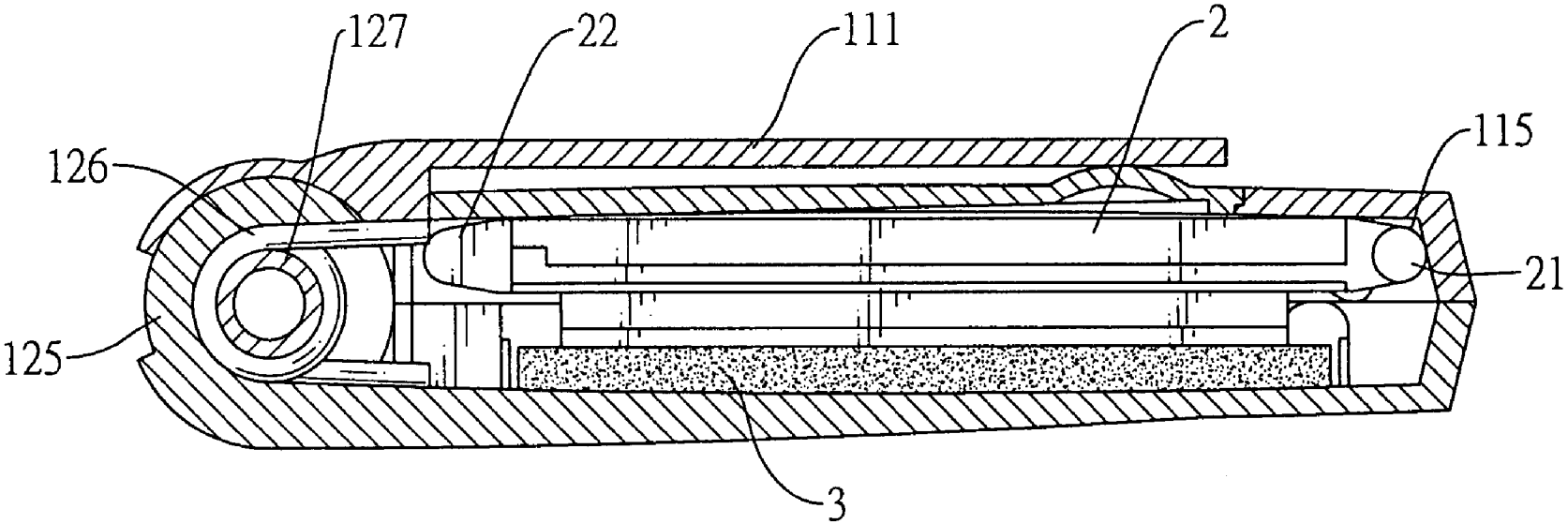
FIG. 2 is a schematic cross sectional view showing the inner structural relationship of the portable stamp assembly.

With reference to FIG. 2 and taking FIG. 1 for reference, it is noted that when the portable stamp assembly of the present invention is assembled, the spring (126) is first mounted around the connecting block (112). Then the connecting block (112) with the spring (126) mounted therearound is placed between the two pivot blocks (125). After inserting the two pins (127) into the two pivot blocks (125) to secure engagement between the upper cover (11) and the lower cover (12), the upper cover (11) is able to pivot relative to the lower cover (12) due to the provision of a resilience force from the spring (126). As depicted from FIG. 2, it is noted that the two ends of the spring (126) are respectively abutted against an inner side face of the upper cover (11) and the lower cover (12) so that the upper cover (11) will automatically detach the lower cover (12) after the ledges (114) are removed from the corresponding clamping slits (124) of the lower cover (12). Thereafter, the two ears (21) of the plate (2) are respectively received in the corresponding pivot holes (115) to allow the plate (2) to pivot relative to the upper cover (11). After assembly of the stamp assembly, it is noted that the plate (2) is entirely received in the first receiving space (116). Furthermore, the plate (2) is provided with a pattern (not numbered) on a side face away from a face defining the first receiving space (116) such that the pattern of the plate (2) is in constant engagement with the ink receptacle (3) to allow the ink to be spread allover the pattern.

Figure 3:
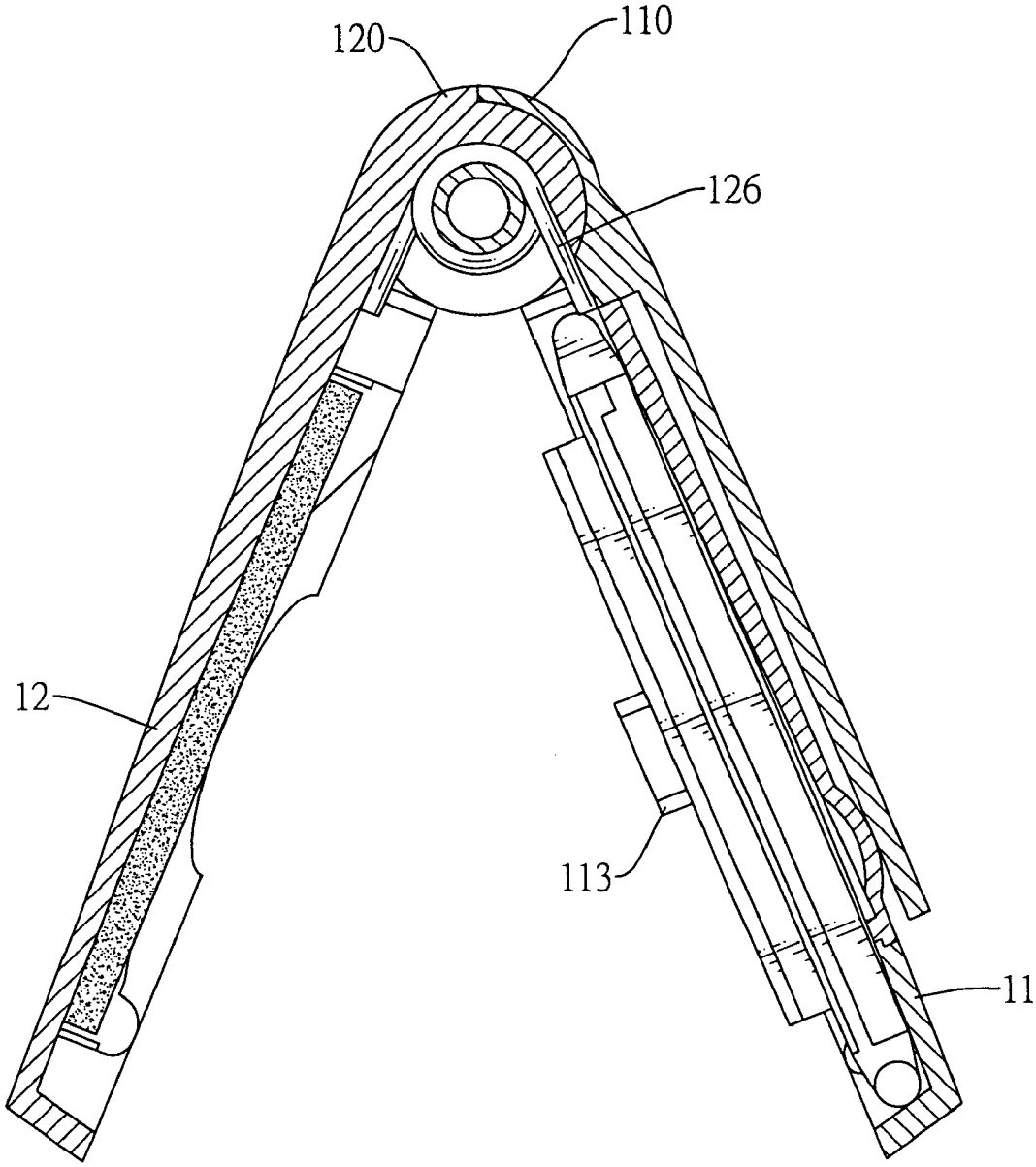
FIG. 3 is a schematic cross sectional view showing that the upper cover is pivoted relative to the lower cover and the plate is yet pivotal relative to the upper cover.
Figure 4:
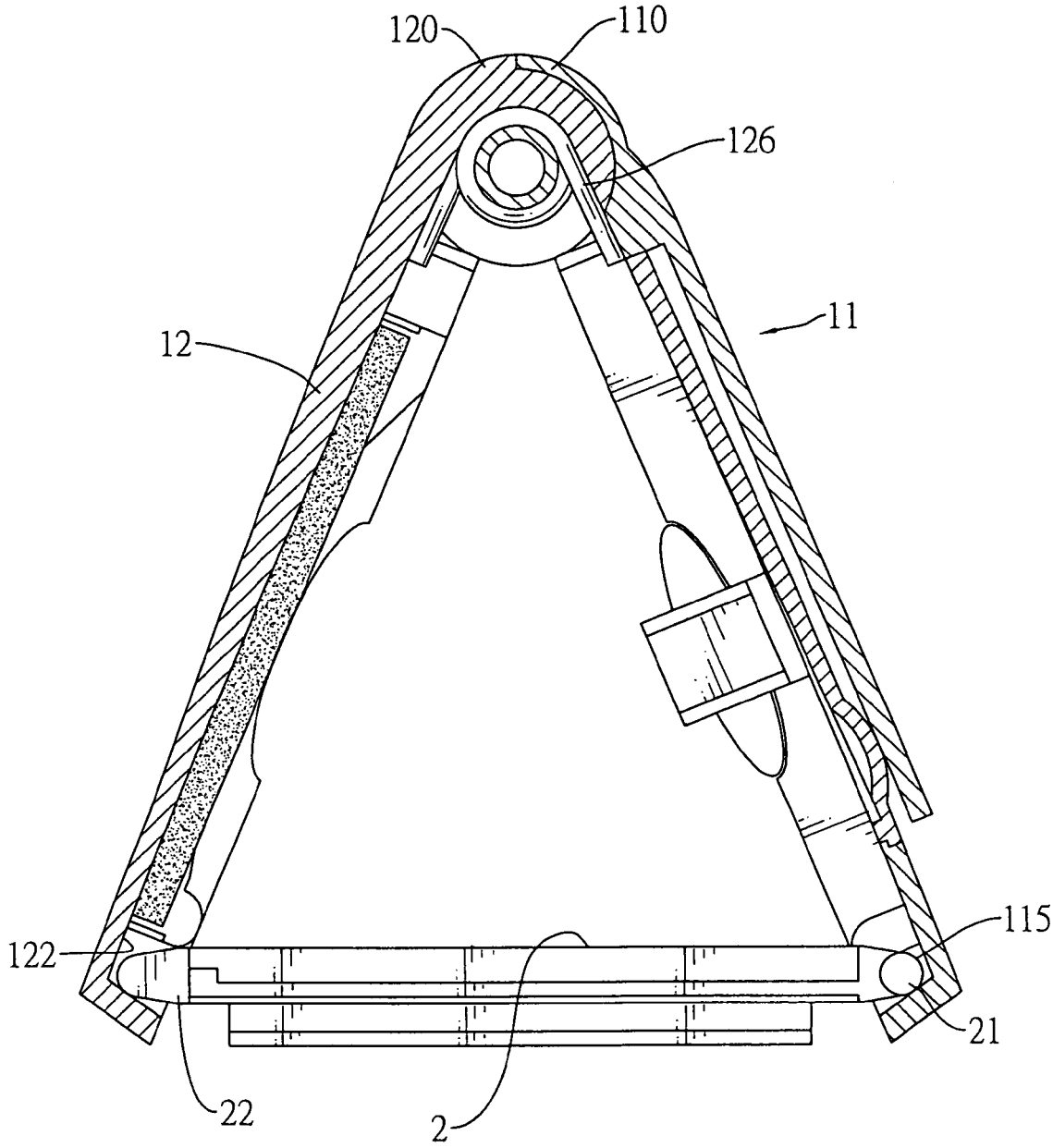
FIG. 4 is a schematic cross sectional view showing that the plate is connected to the lower cover while a side of which is still pivotally connected to the upper cover.

With reference to FIGS. 3 and 4, it is to be noted that after the two arms (113) are pressed toward each other to release the limitation to the ledges (114) by the two clamping slits (124) of the lower cover (12), the resilience force from the spring (126) pushes the upper cover (11) away from the lower cover (12). Then the plate (2) is able to pivot relative to the upper cover (11). Pivoting the plate (2) relative to the upper cover (11) allows the two extensions (22) of the plate (2) to be received in the two receiving recesses (122). As a consequence of the two extensions (22) being received in the two receiving recesses (122), the portable stamp assembly of the present invention is now a triangle and the user is able to hole the outer sides of the upper cover (11) and the lower cover (12) respectively to apply the plate (2) on a surface. That is, the pattern on the plate (2) is ready for printing on a piece of paper.

With the configuration of the present invention, the user will no longer worry about getting stained by the ink from using the stamp.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A portable stamp assembly comprising:

a cover composed of an upper cover and a lower cover pivotally connected to the upper cover and defining a first receiving space in the upper cover and a second receiving space in the lower cover to securely receive therein an ink receptacle;

a plate pivotally connected to the upper cover and having a pattern formed on a side face away from a face defining the second receiving space, the plate being selectively connected to the lower cover and movable between a first position and a second position, wherein the plate is received in the first receiving space of the upper cover to have the pattern in constant engagement with ink inside the ink receptacle while the plate is at the first position and the plate is connected to the lower cover while the plate is at the second position so as to allow the upper cover, the lower cover and the plate to form a triangle.

2. The portable stamp assembly as claimed in claim 1, wherein the upper cover has two pivot holes defined in two opposite inner sides thereof and the plate has two ears to be received in the two pivot holes so that the plate is pivotal relative to the upper cover.

3. The portable stamp assembly as claimed in claim 2, wherein the bottom cover has two receiving recesses and the plate has two extensions selectively received in the two receiving recesses such that after the plate is pivoted to the lower cover, the two extensions are able to be received in the two receiving recesses.

4. The portable stamp assembly as claimed in claim 3, wherein two arms are formed on opposite sides of the upper side and each arm has a ledge, two clamping slits are defined in two opposite sides of the lower cover to correspond to the two ledges so that when the two ledges are received in the two clamping slits, the upper cover and the lower cover are engaged with one another.

5. The portable stamp assembly as claimed in claim 4, wherein a spring is provided between the upper cover and the lower cover to provide a force pushing the upper cover away from the lower cover after the ledges are released from the corresponding clamping slits.

* * * * *